United States Patent [19]

Wickramasuriya

[11] Patent Number: 4,622,931

[45] Date of Patent: Nov. 18, 1986

[54] INLET MANIFOLD

[75] Inventor: Damasius B. Wickramasuriya, South Benfleet, United Kingdom

[73] Assignee: Ford Motor Company, Dearborn, Mich.

[21] Appl. No.: 749,323

[22] Filed: Jun. 27, 1985

[30] Foreign Application Priority Data

Oct. 23, 1984 [GB] United Kingdom ..... 8426721

[51] Int. Cl.[4] ..... F01L 7/10

[52] U.S. Cl. ..... 123/190 A

[58] Field of Search ..... 123/52 M, 80 BA, 80 DA, 123/190 R, 190 A, 190 D, 190 DA

[56] References Cited

U.S. PATENT DOCUMENTS

| | | | |
|---|---|---|---|
| 2,645,214 | 7/1953 | Birnsteil | 123/190 A |
| 2,806,458 | 9/1957 | Mett et al. | 123/190 A |
| 4,354,459 | 10/1982 | Maxey | 123/190 A X |

FOREIGN PATENT DOCUMENTS

| | | | |
|---|---|---|---|
| 2456837 | 1/1981 | France | 123/190 A |
| 0096313 | 7/1980 | Japan | 123/190 A |
| 0148932 | 11/1980 | Japan | 123/190 A |
| 0532408 | 1/1941 | United Kingdom . | |
| 1184525 | 3/1970 | United Kingdom . | |
| 1503086 | 3/1978 | United Kingdom . | |
| 2031999 | 4/1980 | United Kingdom . | |

*Primary Examiner*—Willis R. Wolfe, Jr.

*Attorney, Agent, or Firm*—Robert E. McCollum; Clifford L. Sadler

[57] ABSTRACT

An inlet manifold which has long inlet tracts 12 has valves 26,28 at the downstream ends of the tracts to control the air flow close to the cylinder head 24. Sufficient air for engine idle enters the cylinder head through a bypass passage 42. The valves, which are all linked together, are provided by a rotary spool inside a cylindrical bore which is integrally cast with the manifold. A valving portion 30 is associated with each tract.

2 Claims, 10 Drawing Figures

INLET MANIFOLD

This invention relates to an inlet manifold for an internal combustion engine in which fuel is injected into the intake ports of the cylinder head.

In high performance fuel injected engines, the inlet manifold feeds air to the cylinders, and the downstream part of the inlet manifold provides long separate tracts for feeding each cylinder. Such engines also often have valve overlap, i.e. the inlet valve opens before the exhaust valve closes. With this combination of features, engine performance is very good at high engine speeds, but is poor at low engine speeds because very little suction is developed, and insufficient air is sucked into the cylinders to support combustion.

To prevent the engine stopping instead of idling, it is known to provide a valve at the downstream end of each tract which can close off the respective tract, and an air passage leading into the space between the valve and the cylinder itself. The air passage allows sufficient air for idling to be drawn into the cylinder. Conventionally however a number of interlinked butterfly valves have been used with one valve at the end of each tract. Such valves require independently machined seats, a separate housing from the cast manifold itself and complicated assembly.

According to the present invention, there is provided an inlet manifold for a multi-cylinder internal combustion engine, the manifold having an inlet tract for each cylinder and a valve at the downstream end of each tract, all the valves being connected to a common actuating member and being adapted to close the tracts, characterized in that the manifold has a cylindrical bore, traversing all the tracts at their downstream ends, and a valve member inserted axially in the bore and having a valving portion associated with each tract.

The valve member may have a plug portion associated with each tract, each plug portion having a diametral bore through it which, in the valve open position, allows flow through the valve without any obstruction of the manifold passage. This has advantages over a butterfly type valve in that it does not create unnecessary turbulence upstream of the cylinder. The plug portions which must be able to transmit rotary forces between the plug portions without twisting (which might lead to the action of the plug portions becoming out of phase).

The axis of the bore through each plug portion can be offset from the major diameter of the plug portion so that, seen in cross-section, the bore is bounded by a greater thickness of plug portion material on one side than on the other side. Only the side with greater thickness will be able to close the manifold tracts, but the advantage of this "off-centre" construction is that the diameter of the cylindrical bore can be reduced.

Alternatively the valve member may have a flap associated with each tract, so that in one rotational position of the valve member, the flap extends in line with the passage through the tract to present a minimum resistance to the air flow, and in an opposite rotational position, the flap extends across the passage to block the air flow.

In both these cases, manufacture of the manifold-/valve unit is simplified because the manifold can be cast with a cylindrical bore integral with the tracts and the only machining required is to bring this bore to a single uniform diameter. The valve member can then be inserted in the bore from one end and pushed home.

The invention will now be further described, by way of example, with reference to the accompanying drawings, in which.

Figure 1:
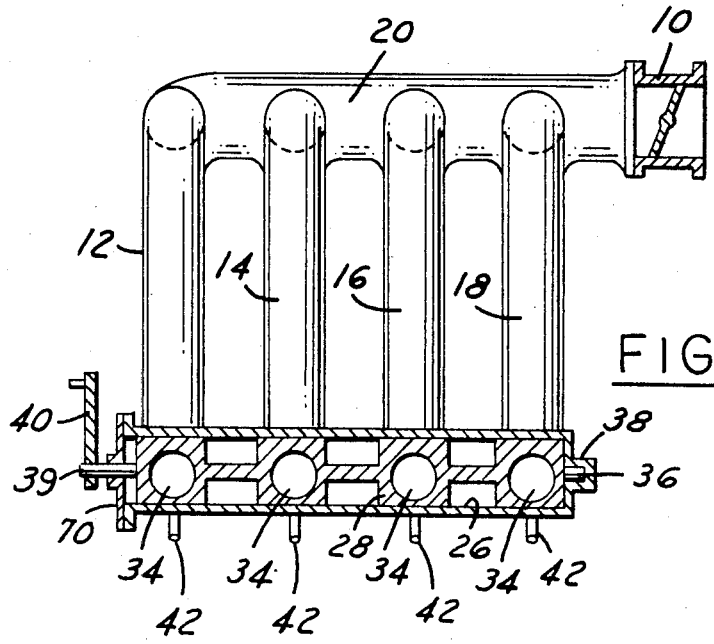
FIG. 1 is a schematic view, partly in section, of a manifold in accordance with the invention.
Figure 2:
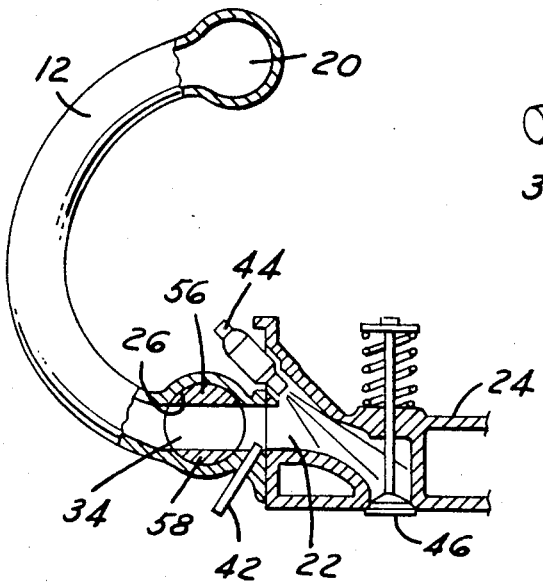
FIG. 2 is a side view, again partly in section, of the manifold of FIG. 1.

The manifold shown in FIG. 1 is arranged downstream of a primary air valve 10, and branches into tracts 12, 14, 16, 18 each feeding one engine cylinder. As can be seen in FIG. 2, the tracts are curved and conduct air from a main manifold passage 20 to an inlet port 22 in the cylinder head 24. At the downstream ends of the tracts, the manifold has a cylindrical, transverse bore 26 and a valve member 28 is fitted in this bore.

Figure 3:
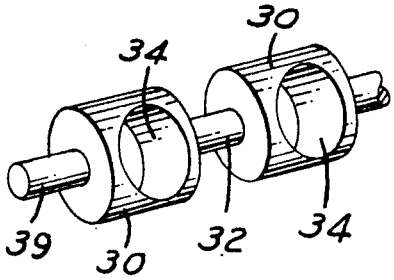
FIG. 3 is a perspective view of part of the valve member used in the manifold of FIGS. 1 and 2.
Figure 7:
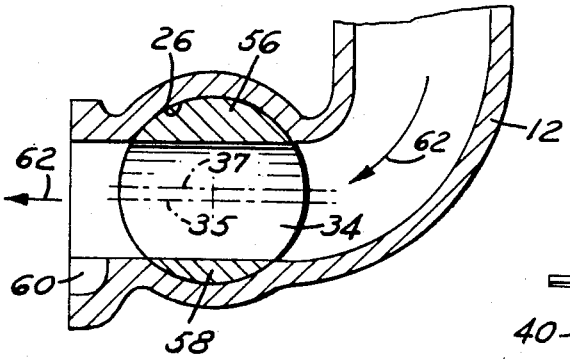
FIGS. 7, 8 and 9 are fragmentary views illustrating the operation of the manifold of FIGS. 1, 2 and 3.
Figure 10:
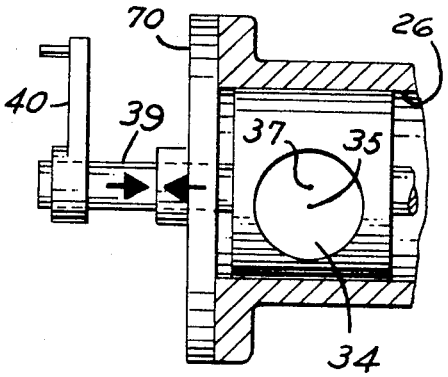
FIG. 10 is an enlarged detail at one end of the manifold and valve member.

The valve member 28 is shown in FIG. 3 and has plug portions 30 joined by shaft portions 32. The plug portions 30 have apertures 34 through them which have the same cross-sectional area as the tracts 12, 14, 16 and 18. The axes 35 of the apertures 34 are offset from the major diameter 37 of the plug portions, as illustrated in FIGS. 7 and 10. The outer diameters of the plug portions are a close fit inside the bore 26 so as to substantially prevent air leakage past the plugs, between the plug outer surfaces and the wall of the bore.

The valve member has a bearing spigot 36 at one end which fits in a socket 38 in the manifold casting, and a control spigot 39 at the other end to which an operating arm 40 is fixed. The arm 40 is turned to open and close the tracts, and when this is done, all the tracts are opened or closed simultaneously.

Downstream of the bore 26, idle air passages 42 enter each tract. FIG. 2 also shows, for one cylinder, a fuel injector 44 and an inlet valve 46.

Figure 4:
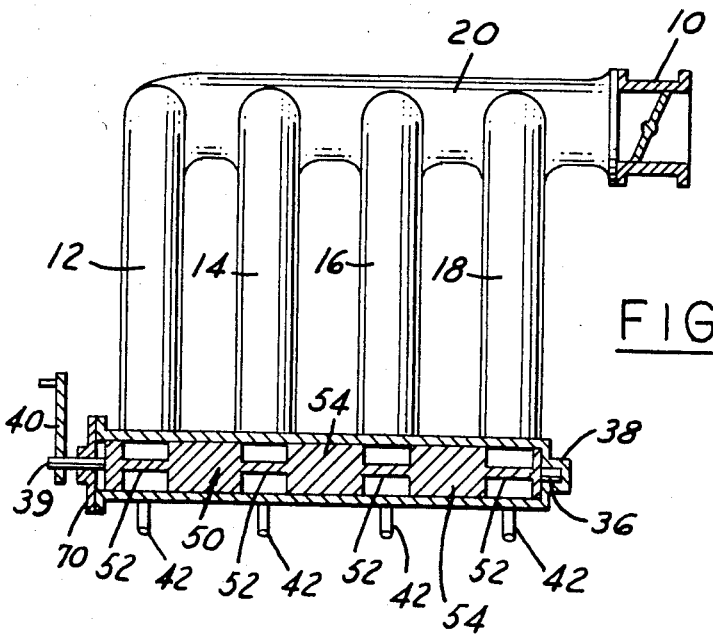
FIGS. 4, 5 and 6 are views corresponding to FIGS. 1, 2 and 3 of an alternative form of manifold in accordance with the invention.
Figure 5:
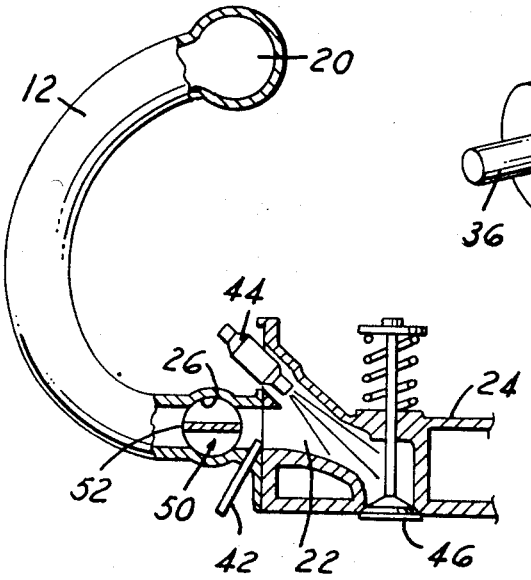
Figure 6:
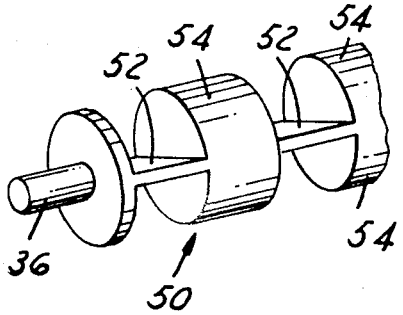

In the alternative embodiment of FIGS. 4, 5 and 6, parts which correspond to parts already described with reference to the earlier Figures bear the same reference numbers. In fact the only part which has changed substantially is the valve member 50 which now has a flap portion 52 associated with each tract and a plug portion 54 connecting the flap portions. The wide open position of this valve member 50 is shown in FIG. 5, and it will be seen that the flap 52 lies parallel with the flow direction through the tract 12. This may lead to some undesirable turbulence in the air flow, but this embodiment does have one advantage over the embodiment shown in FIGS. 1, 2 and 3 which is that the bore 26 can be of smaller diameter, since there is no longer a need to house the peripheral sections 56 and 58 of the plug portions 30 outside the flow passage through the valve.

The valve member can take up any position intermediate its end positions and, in combination with control of the primary valve 10, this can allow fine tuning of the air flow through the tracts for optimum engine operation.

Figure 8:
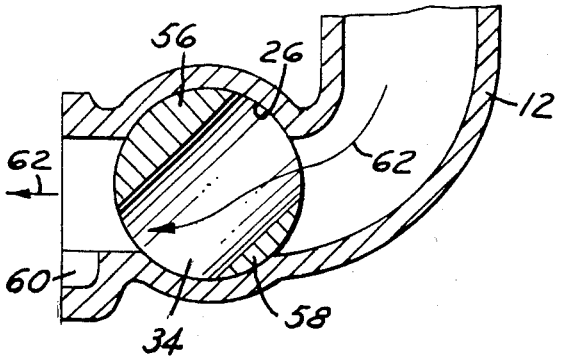
Figure 9:
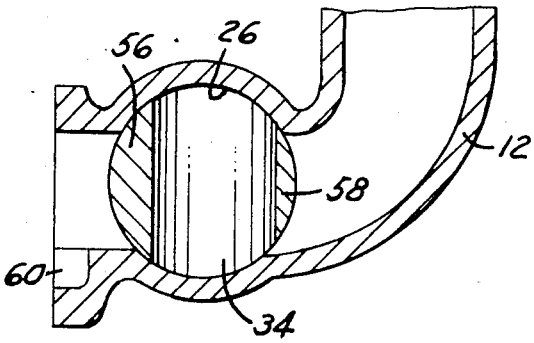

FIG. 7 shows the wide open valve position; FIG. 8 shows a partially open position and FIG. 9 shows the fully closed position. In FIGS. 7 and 8, the air flow direction is shown by arrows 62. In FIGS. 7 to 9, the face of the manifold which will butt against the cylinder head has a cast-in channel 60 which serves as an air inlet passage to all the inlet ports, in place of the separate idle air passages 42 shown in the preceding Figures.

The valving arrangements described are very simple to manufacture and are likely to have few reliability problems in service. Since the valve member is a single piece, there are no internal fastenings to come loose. Only a single, simple machining process is required to prepare the bore 26 for the insertion of the valve member, and the assembly is simple since the member 28 just slides into one end of the bore before being secured there by an end plate 70. Rotation of the valve member can be controlled by any suitable mechanism.

Because of the eccentricity of the apertures 34 in the valve member 28, it is important that the valve member be assembled to the bore in the correct position. FIG. 10 shows how marker arrows 72 can be provided on the end plate 70 and on the control spigot 39 to facilitate correct lining up of these parts in assembly. It will be appreciated that, since the invention seeks to minimise the volume connected to the inlet port at idle, it should be the downstream side of the bore 26 where the valve acts, as seen in FIG. 9.

I claim:

1. An inlet manifold for a multicylinder internal combustion engine, the manifold having an inlet tract for each cylinder and a valve at the downstream end of each tract, all the valves being connected to a common actuating member and being adapted to close the tracts, characterized in that the manifold has a cylindrical bore traversing all the tracts at their downstream ends, and a valve member inserted axially in the bore and having a valving portion associated with each tract, the valve member having a plug portion associated with each tract, each plug portion having a bore through it which, in the valve open position, allows flow through the valve without any obstruction of the manifold passage, the axes of the bores being offset from the major diameters of the plug portions.

2. A manifold as claimed in claim 1, wherein the plug portions are connected by reduced diameter shaft portions.

* * * * *